United States Patent [19]

Sack et al.

[11] 4,153,492

[45] May 8, 1979

[54] METHOD OF FORMING A DRY WELL FUSEHOLDER

[75] Inventors: Stanley F. Sack, St. Andrews E.; Morris Mattuck, Lachute, both of Canada

[73] Assignee: Canadian General Electric Company, Ltd., Toronto, Canada

[21] Appl. No.: 861,093

[22] Filed: Dec. 15, 1977

Related U.S. Application Data

[62] Division of Ser. No. 680,209, Apr. 26, 1976, Pat. No. 4,081,778.

[30] Foreign Application Priority Data

Sep. 8, 1975 [CA] Canada ..... 234994

[51] Int. Cl.[2] ..... B65H 81/04; H01H 85/02

[52] U.S. Cl. ..... 156/172; 29/623; 156/304

[58] Field of Search ..... 156/172, 169, 173, 175, 156/425, 304; 285/DIG. 26, 423, DIG. 20, 239; 138/154, 144, 103, 155; 337/201, 205, 246, 247, 248, 186, 204; 29/623

[56] References Cited

U.S. PATENT DOCUMENTS

| | | | |
|---|---|---|---|
| 2,945,541 | 7/1960 | Maly et al. | 285/DIG. 26 |
| 3,662,309 | 5/1972 | Harmon | 337/202 |
| 3,699,490 | 10/1972 | Macemon | 337/205 |
| 3,723,930 | 3/1973 | Koch | 337/246 |
| 3,835,432 | 9/1974 | Cainone | 337/186 X |

*Primary Examiner*—Michael W. Ball

*Attorney, Agent, or Firm*—William Freedman; Carl L. Silverman

[57] ABSTRACT

A dry well fuseholder for use with electrical apparatus containing a dielectric liquid. The holder has an outer, liquid-tight, tubular shell and a number of components inside the shell abutting coaxially in the following order: an annular fitting adapted for supporting the fuseholder on the apparatus; an insulating tube; an annular fuse terminal; another insulating tube; and an annular fuse terminal closed at one end. Glass fibers bonded together with epoxy resin are wound over the peripheral surface of the fitting-tube assembly to produce the shell. Seals are located between the fittings and shell near the joints of fittings and tubes. These seals are composed of a material which swells on contact with the dielectric liquid.

6 Claims, 2 Drawing Figures

12
19
14
18
17
36
29
28
25
11
27
10
2
32
20
21
15
33
2
26
34
22
16
35
37
24
13
23

25
27
30
32
21
31
33
26

METHOD OF FORMING A DRY WELL FUSEHOLDER

This is a division, of application Ser. No. 680,209, filed Apr. 26, 1976, now U.S. Pat. No. 4,081,778.

BACKGROUND OF THE INVENTION

This invention relates to a fluid-tight holder for a current-limiting fuse.

It is known to protect liquid-cooled electrical apparatus such as a pad-mounted distribution transformer with one or more fuses located inside the apparatus enclosure. Each fuse is located inside a liquid-tight holder and the holder is located inside the enclosure at least partially submerged in the liquid coolant. The holder is, in effect, an open ended container secured at its open end over an opening in a wall of the enclosure so the fuse is accessible for replacement without disturbing the apparatus.

This type of fuseholder is a composite structure of a tubular shell made of insulating materials and three fittings. One fitting is a metal fuse terminal which also closes one end of the tube, the second fitting is a means for mounting the open end of the tube on the wall of the apparatus with the tube opening in register with the wall opening, and the third fitting is a metal fuse terminal located between the other two fittings. One known fuseholder is a filament wound structure. This structure is a shell composed of interlaid filaments bonded together with a resinous material and includng the fittings as integral parts of the structure. Glass fibers bonded together with an epoxy or polyester resin are examples of suitable materials. Resin bonded fibers produce a strong structure which is also a good electrical insulator and impervious to the liquid coolant. However, it has proven difficult to produce a filament wound fuseholder which is leakproof at the interfaces of the fittings with the filament wound body. This is believed to be due chiefly to differences in thermal expansion of the fiber-resin materials and the fitting materials. Because the fuseholder is usually in contact with the liquid coolant, it is usually subjected to the same temperatures as the coolant. These temperatures can range from well below freezing to near boiling of water.

The object of this invention is to provide improved seals at the interfaces of the body and the fittings in a filament wound fuseholder.

SUMMARY OF THE INVENTION

A fuseholder according to the invention has three annular fittings alternating with two annular insulating tubes in a coaxial array, a wrapping of resin bonded fibers around the array, and at least one annular seal lightly compressed between each fitting and the outer wrapping. The seals are made of a material which swells upon coming into contact with the liquid coolant, whereupon the effectiveness of the seal increases. Preferably, each seal is located in an annular groove in the fitting, which groove constrains swelling of the seal to exerting pressure against the fitting and the outer wrapping. Each one of the two end fittings may be provided with another annular groove for keying the wrapper to the fitting.

Certain silicone elastomers have the property of swelling when they come into contact with electrical grade mineral oils. These mineral oils are well known for their good electrical properties, and used extensively as insulating coolants in apparatus of the type where this fuseholder is also used, e.g., pad-mounted distribution transformers. A silicone elastomer suitable for the annular seals is a phenyl methyl polysiloxane which swells on coming into contact with transformer oil and retains its sealing properties at both high and low temperatures.

DESCRIPTION OF PREFERRED EMBODIMENT

Figure 1:
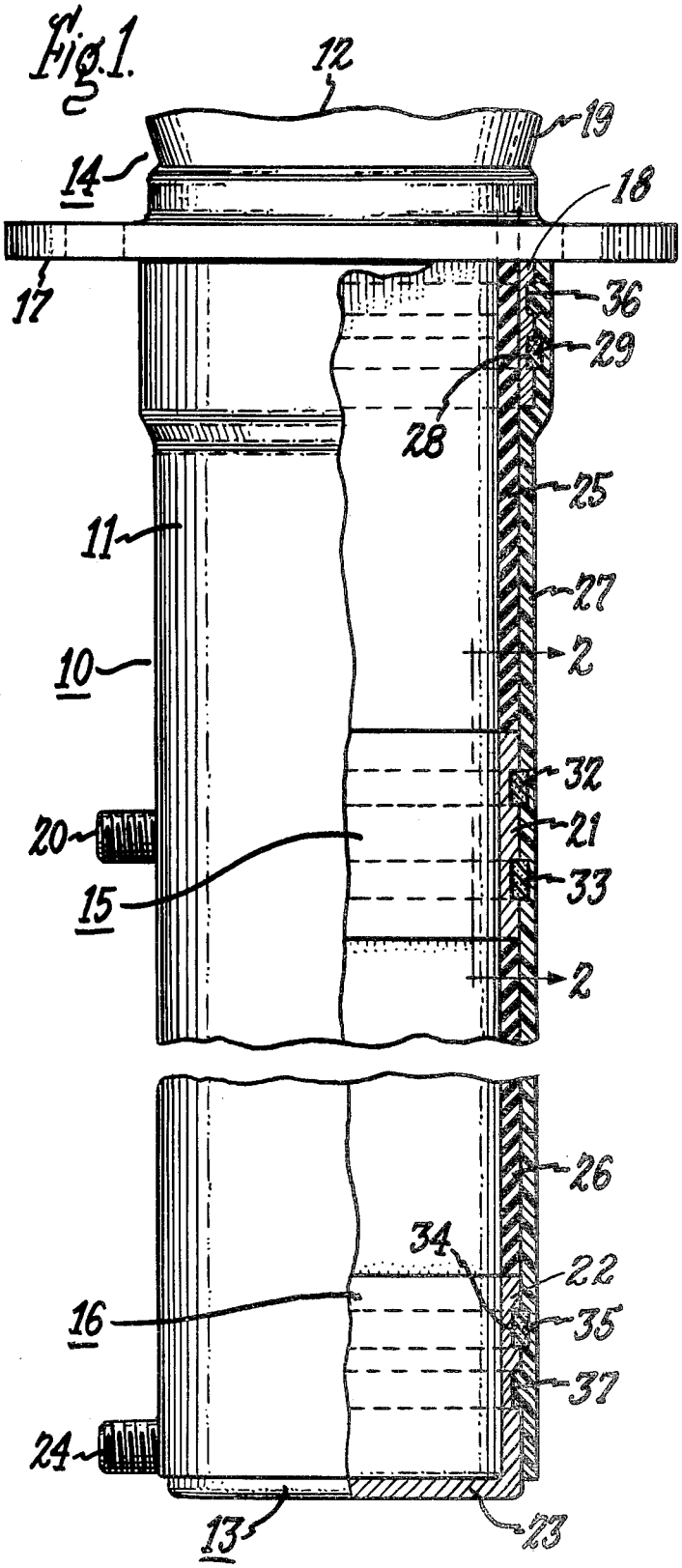
FIG. 1 is a sectional view of the preferred embodiment of the invention.
Figure 2:
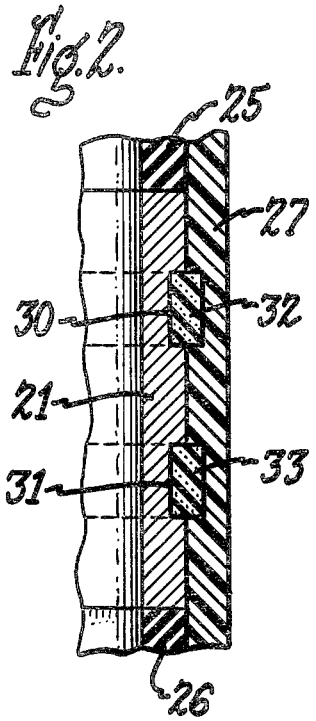
FIG. 2 is a partial sectional view on an enlarged scale taken on the line 2—2 of FIG. 1.

An embodiment of the invention will now be described with reference to the accompanying drawing.

There is shown in this drawing a fuseholder 10 in the general form of an insulating tube 11 open at one end 12, closed at the other end 13, and incorporating three fittings 14, 15 and 16. This is a composite structure of resin bonded fiber glass and three fittings bonded together to provide an open ended container for a current-limiting fuse. This type of fuseholder is intended to be located inside an apparatus enclosure containing a dielectric liquid. An example of such apparatus is a distribution transformer containing an electrical grade mineral oil which serves as a coolant and an insulator. The holder is inserted into the enclosure through an opening in a wall thereof (not shown) and is secured to this wall by means of the flange 17 so that open end 12 of the holder is accessible from outside the apparatus for inserting or withdrawing a fuse. In the structure illustrated, flange 17 is an integral part of the fitting 14, which fitting also includes the exposed opening of the fuseholder.

Fitting 14 has an annular portion 18 on one side of flange 17 and a flared annular fuse receiving mouth 19 on the other side of the flange. This fitting may be made of steel or some other mechanically strong material. Fitting 15 is an annular member having a terminal stud 20 projecting radially outward from its wall 21. Since this fitting is one fuse contact, it is made of an electrical conductor such as copper. Fitting 16 is a cup-shaped member having an annular portion 22 integral with a wall 23 and a terminal stud 24 projecting radially outward from the annular portion 22. This fitting closes off the end 13 of the fuseholder and provides the other fuse contact. It may be made of copper or steel.

The three fittings alternate with two annular insulating tubes 25 and 26 in a coaxial arrangement in the following order: fitting 14, tube 25, fitting 15, tube 26, and fitting 16. One end of tube 25 fits freely inside the circular opening through the center of fitting 14, and the other end of the tube abuts on edge of fitting 15. Tube 26 has its ends abutting the edges of fittings 15 and 16 respectively. Tubes 25, 26 and fittings 15, 16 have the same internal diameter and are aligned axially so that the assembly presents a uniform inner surface. Preferably, tubes 25 and 26 are made of resin bonded filaments, e.g., epoxy ponded fiber glass.

The assembly 14, 25, 15, 26, and 16 is contained within a shell 27 of an insulating material. This shell is a wrapping of resin bonded filaments, e.g., a multilayer winding of criss-crossed glass fibers bonded together by means of an epoxy resin. The shell is also bonded to the fittings and inner tubes.

The annular portion 18 of fitting 14 is formed with a peripheral groove 28 near its lower edge, and this groove contains a seal 29. The peripheral surface of fitting 15 contain grooves 30 and 31 near the edges of wall 21, and these grooves contain seals 32 and 33 respectively. The annular portion 22 of fitting 16 is formed with a peripheral groove 34 near its upper edge, and this groove contains a seal 35. The annular portions 18 and 22 of fittings 14 and 16 contain peripheral grooves 36 and 37 respectively. These two grooves are located near the ends of shell 27 and their function is to key the shell to the fitting.

Preferably, grooves 28, 30, 31 and 34 are alike and rectangular in cross section, as are the seals in them. Seal 29, 32, 33 and 35 completely fill their grooves and are lightly compressed therein by the overwound shell 27. The four seals are made of a silicone elastomer, e.g., a phenyl methyl polysiloxane elastomer, which swells upon coming into contact with the mineral oil in the apparatus. This swelling tightens the seals to the extent that the joints between shell 27 and fittings 14, 15 and 16 are rendered leakproof, thereby keeping the fuseholder dry inside. These seals are effective at both high and low temperatures.

The preferred method of making the fuseholder will now be described. It involves a procedure for assembling a number of preformed components and applying a shell over them. The preformed components are the following: fittings 14, 15 and 16; tubes 25 and 26; seals 29, 32, 33 and 35; and studs 20 and 24. Studs 20 and 24 are not secured to fittings 15 and 16 at this stage of manufacture. The fittings and tubes should have clean outer surfaces, the fittings surfaces having been plated with a corrosion resistant metal and the tube surfaces ground. The procedural steps are as follows:

1. Seals 29, 32, 33 and 35 are placed around the respective fittings 14, 15 and 16 but not necessarily in the grooves.

2. Fittings 14, 15 and 16 and tubes 25 and 26 are asembled on a cylindrical mandrel. This mandrel has one end portion that is a snug fit inside these components, and another end portion adapted to be supported in a machine which will rotate the mandrel on its axis. The components are placed on said one end portion of the mandrel in the abutting relation shown in the drawing in the following order; fitting 14, tube 25, fitting 15, tube 26, and fitting 16.

3. A thixotropic sealing medium is applied to all the joints between fittings and tubes. This medium is also applied in grooves 28, 30, 31 and 34; seals 29, 32, 33 and 35. It may be a compound of a flexible epoxy resin serving as a flexible modifier for conventional liquid epoxies. The first product has good flexibility, elongation and impact resistance.

4. The sealing medium is heat cured. This may be done by slowly rotating the mandrel with the assembly exposed to a heat lamp. After the material is cured, any surplus is sanded off.

5. This is the outer shell winding step. However, before it is begun, the outer surface of the assembly should be checked for cleanliness. If necessary, the surface may be cleaned with a suitable solvent. Resin impregnated glass fibers are now wound around the assembly of components 14, 15, 16, 25 and 26. This is done by rotating the assembly on the axis of the mandrel and laying the fibers on the outer surface of the aforementioned components in a number of layers extending from flange 17 to wall 23. The turns are laid on in an oblique fashion so the fibers in adjacent layers cross. The fibers used are in a bundle of a number of parallel stands. This bundle of strands is passed through a catalyzed epoxy resin as it is wound according to a process well known for making tubing. In order to improve the bond between the winding and the overwound components, the outer surfaces of the components are wetted with this same resin just before winding begins.

6. The resin is then cured by means of heat, e.g., for three hours at 180°–200° F. and then one hour at 275° F. The mandrel will be retained in the assembly for at least the initial cure.

7. Finally, when the resin is fulled cured and the mandrel removed, holes are drilled for studs 20 and 24 and the studs resistance welded to the fittings.

What is claimed as new and which it is desired to secure by Letters Patent of the U.S. is:

1. A method for producing a leakproof electrical fuseholder having a first annular fitting with fuseholder mounting means thereon, a second conductive annular fitting, a third conductive annular fitting having an end closure, first and second insulating tubes, and a resin bonded filament wound outer shell supporting said fittings and tubes alternately in an abutting coaxial array having a uniform inner cylindrical surface, said method comprising the following steps;

(1) Placing at least one annular seal around the peripheral surface of said first and third fittings near the edge thereof abutting a tube, and placing at least two annular seals around the peripheral surface of said second fitting near the edges thereof abutting the tubes, said seals being composed of a material which swells on contact with a dielectric liquid;

(2) Supporting said fittings and tubes on a mandrel in abutting relation in the following order; first fitting, first tube, second fitting, second tube, and third fitting;

(3) Winding resin impregated filaments in a predetermined geometric pattern over said fittings and tubes to form an elongated shell;

(4) Curing the resin by means of heat to provide a solid wound shell of resin bonded filaments; and

(5) Removing the mandrel.

2. A method according to claim 1 wherein each seal is placed in a preformed annular groove in the fitting in the case of step (1).

3. A method according to claim 2 wherein the peripheral surface of the fitting-tube assembly is wetted with the filament bonding resin prior to filament winding of step (3).

4. A method according to claim 1 wherein a thixotropic sealing medium is applied to the seals and to the joints between fittings and tubes prior to filament winding of step (3).

5. A method according to claim 4 wherein the peripheral surface of the fitting-tube assembly is wetted with the filament bonding resin prior to filament winding of step (3).

6. A method according to claim 1 wherein the peripheral surface of the fitting-tube assembly is wetted with the filament bonding resin prior to filament winding of step (3).

* * * * *